US007779924B2

(12) United States Patent
Clamens

(10) Patent No.: US 7,779,924 B2
(45) Date of Patent: Aug. 24, 2010

(54) METHOD AND APPARATUS FOR USE IN A WELLBORE

(75) Inventor: Jack G. Clamens, Fairview, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 3 days.

(21) Appl. No.: 12/129,229

(22) Filed: May 29, 2008

(65) Prior Publication Data

US 2009/0294118 A1 Dec. 3, 2009

(51) Int. Cl.
*E21B 23/01* (2006.01)

(52) U.S. Cl. ..... 166/382; 166/208; 166/384; 166/387

(58) Field of Classification Search ..... None
See application file for complete search history.

(56) References Cited

U.S. PATENT DOCUMENTS

| | | | | |
|---|---|---|---|---|
| 3,297,092 | A | 1/1967 | Jennings | |
| 3,391,962 | A | 7/1968 | Ruse | |
| 4,482,086 | A | 11/1984 | Wagner et al. | |
| 4,678,209 | A | 7/1987 | Guice | |
| 4,815,770 | A * | 3/1989 | Hyne et al. | 285/123.12 |
| 5,119,861 | A | 6/1992 | Pino | |
| 5,709,269 | A | 1/1998 | Head | |
| 5,988,276 | A | 11/1999 | Oneal | |
| 6,123,148 | A | 9/2000 | Oneal | |
| 6,182,755 | B1 | 2/2001 | Mansure | |
| 6,199,628 | B1 | 3/2001 | Beck et al. | |
| 6,484,805 | B1 | 11/2002 | Perkins et al. | |
| 6,651,747 | B2 | 11/2003 | Chen et al. | |
| 6,688,399 | B2 | 2/2004 | Maguire et al. | |
| 6,691,789 | B2 | 2/2004 | Jackson et al. | |
| 6,742,585 | B1 | 6/2004 | Braithwaite et al. | |
| 6,782,946 | B2 | 8/2004 | Perkins et al. | |
| 7,228,915 | B2 | 10/2004 | Thomson | |
| 6,834,725 | B2 | 12/2004 | Whanger et al. | |
| 6,848,505 | B2 | 2/2005 | Richard et al. | |
| 6,896,049 | B2 | 5/2005 | Moyes | |
| 6,896,052 | B2 | 5/2005 | Simpson et al. | |
| 6,959,759 | B2 | 11/2005 | Doane et al. | |

(Continued)

FOREIGN PATENT DOCUMENTS

| | | |
|---|---|---|
| EP | 1407113 B1 | 4/2004 |

OTHER PUBLICATIONS

"Best Completion Technology Award", *World Oil Awards*, (2006), p. A-9.

(Continued)

*Primary Examiner*—Zakiya W. Bates
(74) *Attorney, Agent, or Firm*—Schwegman, Lundberg & Woessner, P.A.

(57) ABSTRACT

A hanger assembly and method for its use is included, along with various examples of alternative constructions for the hanger assembly. Also included are examples of new tool strings having capabilities facilitated as a result of use of the hanger assemblies. The hanger includes a deformable section that facilitates engaging contact with a surrounding structure. In preferred examples this engagement is achieved by use of a first deformable section of the hanger that extends radially outwardly from the remainder of the hangar body when the hanger is set; and a contact member that is further urged radially outwardly relative to that deformable section when the hanger is set.

33 Claims, 7 Drawing Sheets

U.S. PATENT DOCUMENTS

| | | | |
|---|---|---|---|
| 6,997,266 | B2 | 2/2006 | Jackson et al. |
| 7,044,231 | B2 | 5/2006 | Doane et al. |
| 7,051,810 | B2 | 5/2006 | Clemens et al. |
| 7,086,480 | B2 | 8/2006 | Simpson et al. |
| 7,090,024 | B2 | 8/2006 | Simpson et al. |
| 7,121,352 | B2 | 10/2006 | Cook et al. |
| 7,134,506 | B2 | 11/2006 | Moyes |
| 7,143,832 | B2 | 12/2006 | Freyer |
| 7,172,027 | B2 | 2/2007 | Simpson et al. |
| 7,228,896 | B2 | 6/2007 | Gazewood |
| 7,234,553 | B2 | 6/2007 | Shimizu et al. |
| 7,258,168 | B2 | 8/2007 | Cook et al. |
| 7,287,584 | B2 | 10/2007 | Angman et al. |
| 7,290,605 | B2 | 11/2007 | Waddell et al. |
| 2003/0178204 | A1 | 9/2003 | Echols et al. |
| 2003/0183395 | A1 | 10/2003 | Jones |
| 2003/0234111 | A1 | 12/2003 | Echols |
| 2004/0261990 | A1 | 12/2004 | Bosma et al. |
| 2007/0227730 | A1 | 10/2007 | Brisco et al. |
| 2008/0000645 | A1 | 1/2008 | Brisco et al. |

OTHER PUBLICATIONS

"Zeroth Technology Z-Seal", [online]. [retrieved Jul. 17, 2006]. Retrieved from the Internet: <URL: www.zertech.com/zseal.htm>, 2 pgs.

"Zertech Z-Seal", 4 pgs.(prior to 1 year before the filing date of this application).

* cited by examiner

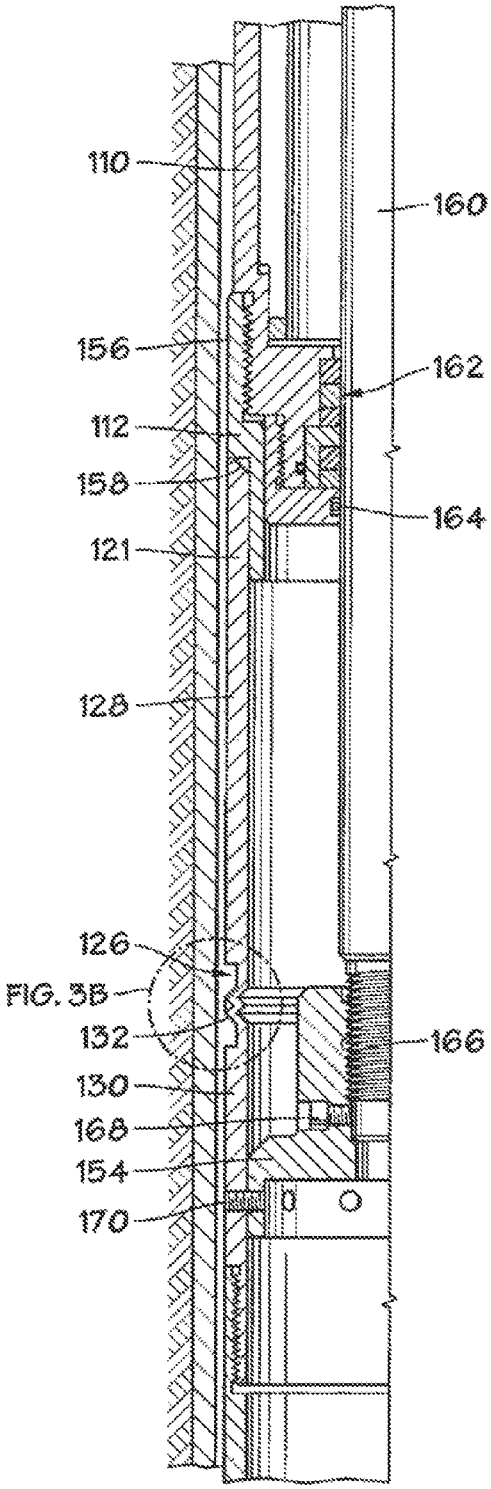
FIG. 3A
FIG. 3B
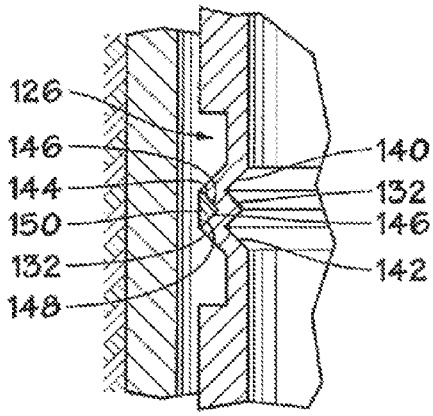

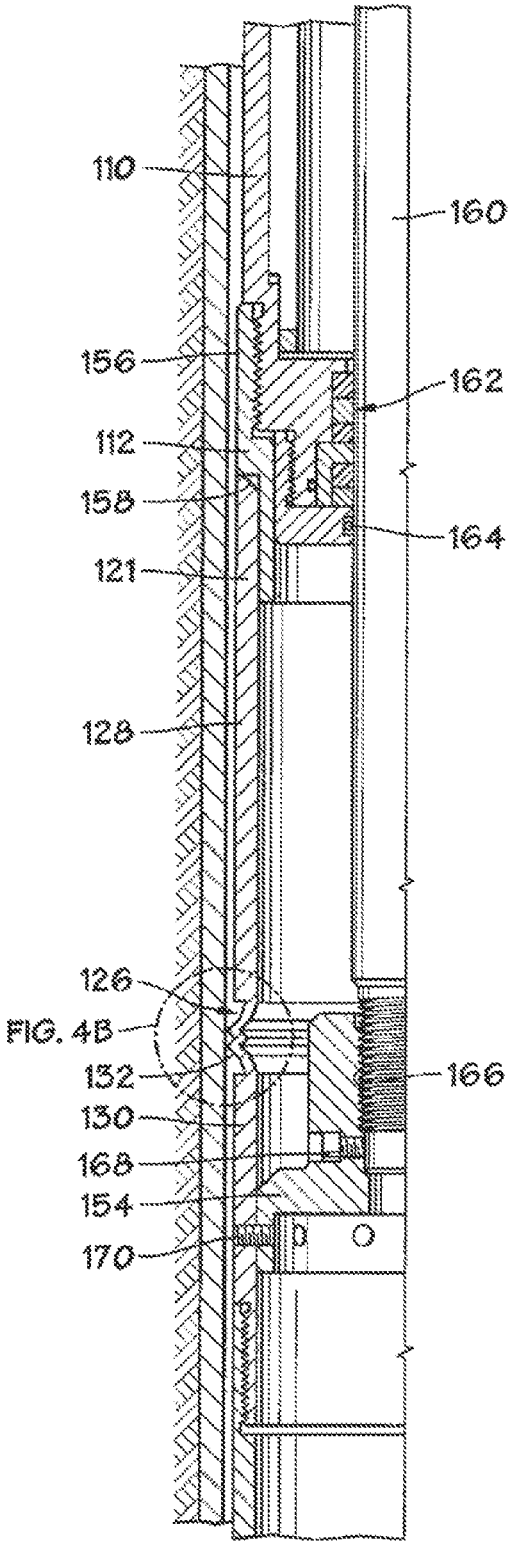
FIG. 4A
FIG. 4B
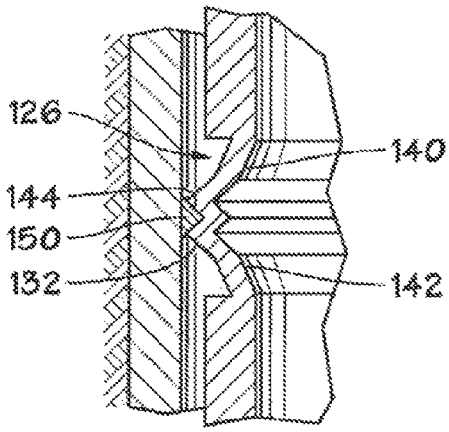

FIG. 5
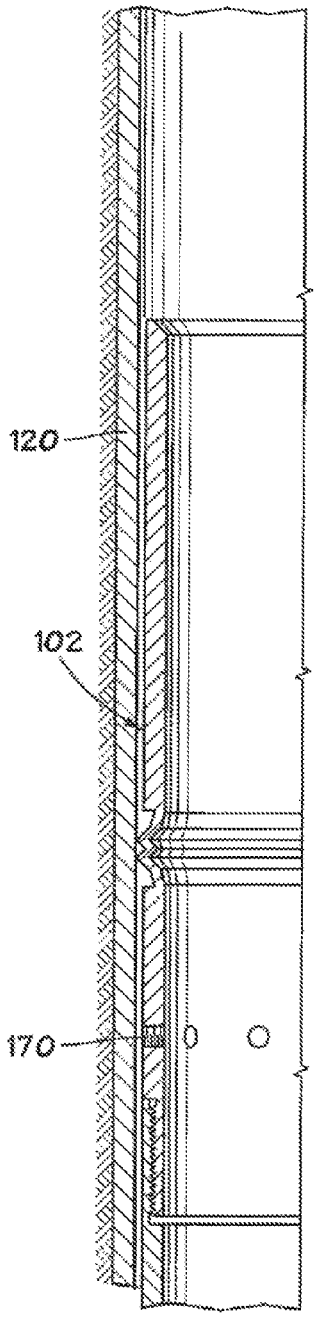
FIG. 6
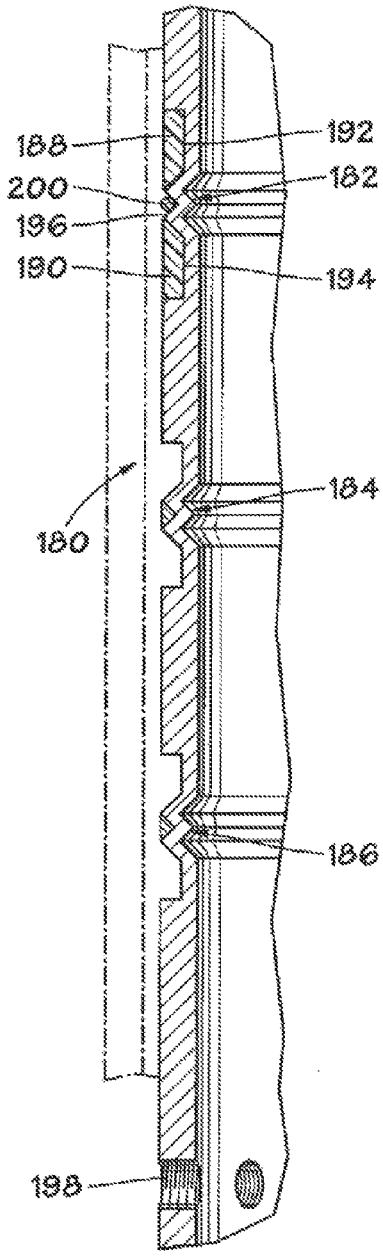
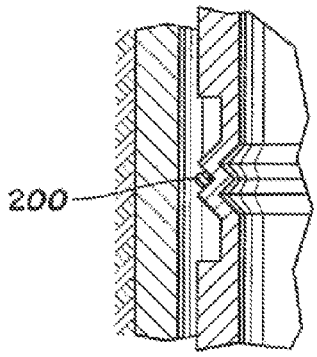
FIG. 7

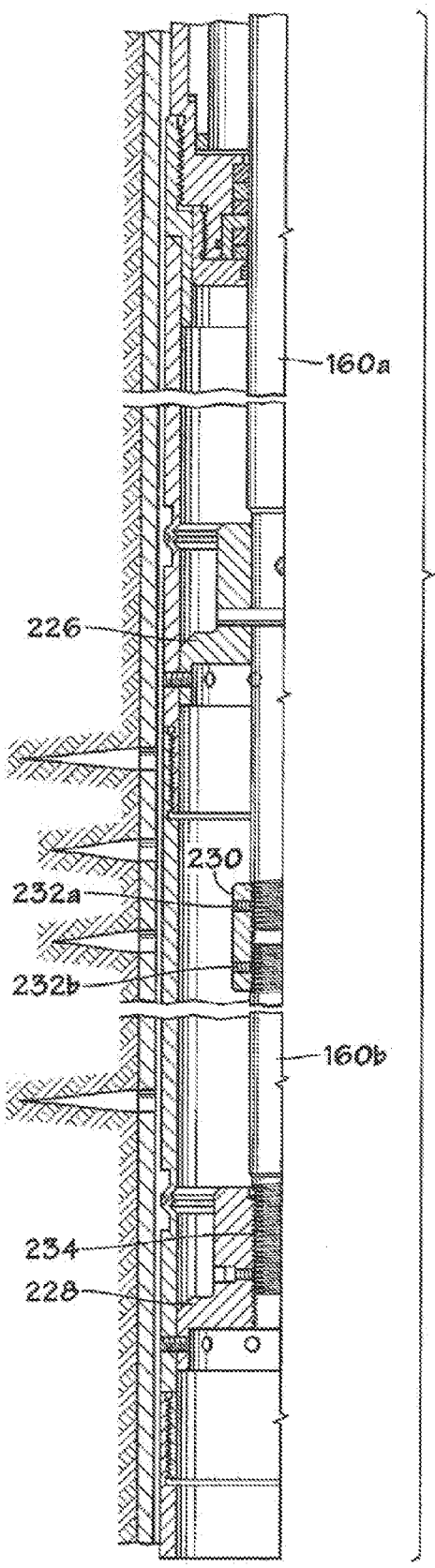
FIG. 8
FIG. 9
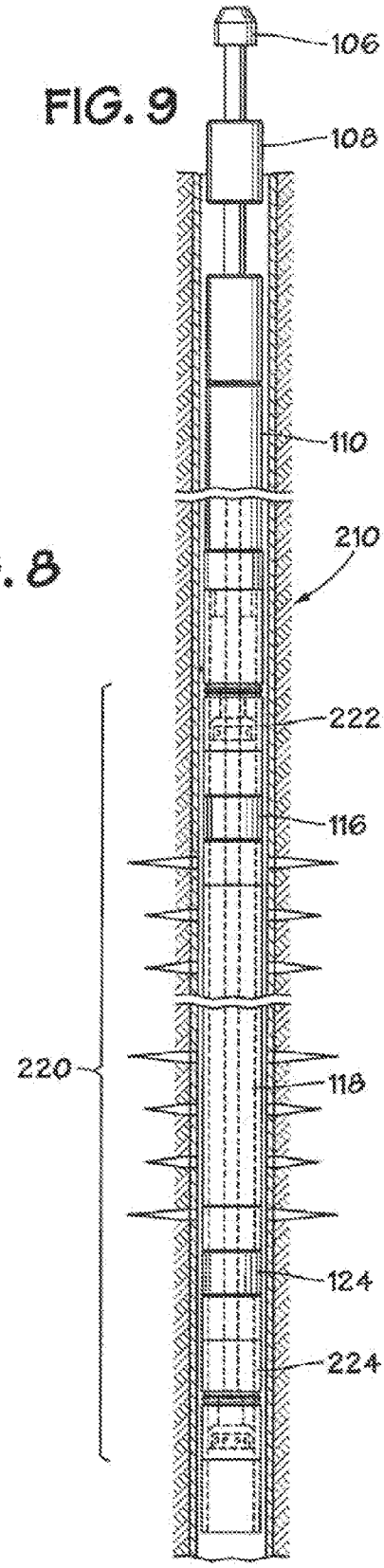

FIG. 10A
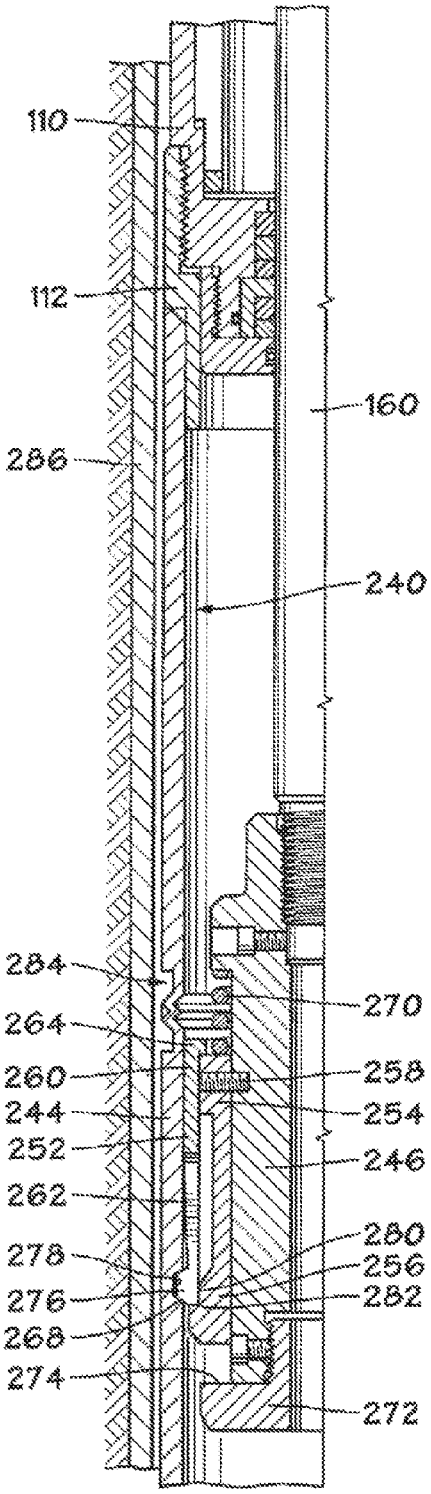
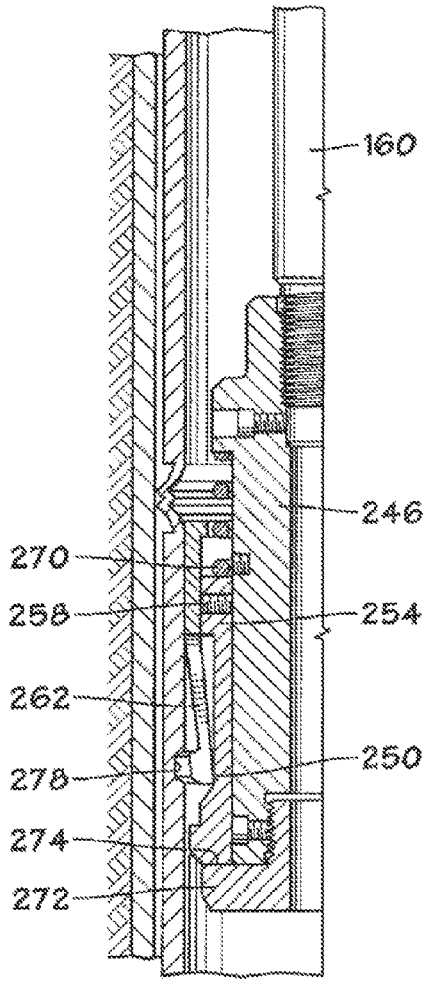
FIG. 10B

FIG. 11A
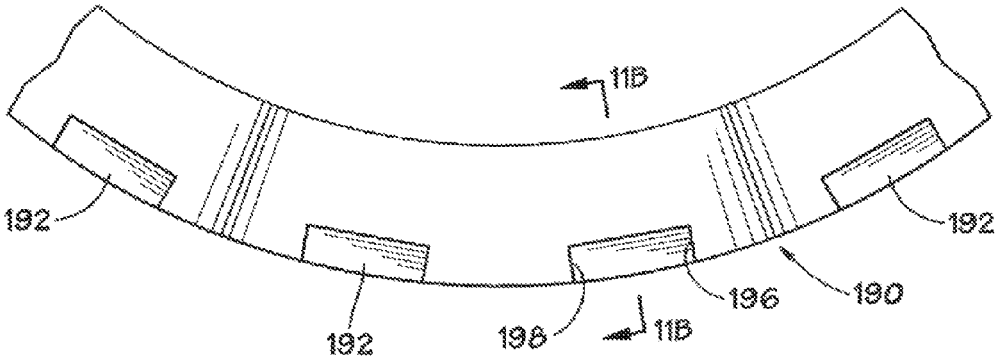
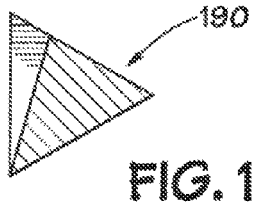
FIG. 11B
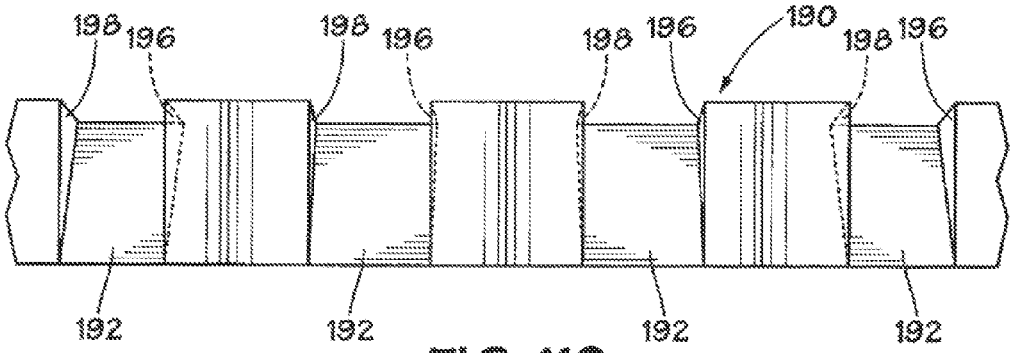
FIG. 11C

METHOD AND APPARATUS FOR USE IN A WELLBORE

BACKGROUND

The present invention provides new methods and apparatus for use in a wellbore, particularly for supporting structures inside a tubular member within the wellbore. In addition to many other applications, the described methods and apparatus offer particular advantages when used within systems configured to repair damaged casing or other tubulars within a wellbore.

A number of different types of devices are known in the industry for use in supporting structures such as various tool strings within a casing or other tubular member disposed with a wellbore. For example, many types of hydraulically or mechanically actuated packers are known for such uses. However, in general, such packers will often be relatively expensive for many applications, such as those where the sole need is specifically to just physically support a structure within a casing or other tubular.

Similarly, many configurations of casing hangers are known that use moveable slip elements, similar to those on many packers, to engage the casing or other tubular. Again, casing hangers are often relatively complex and expensive for some applications. This can be particularly true where the intent is to secure a structure downhole where it will remain permanently. One example of such a use is where a repair assembly is to be put in place, such as to bridge across a section of damaged casing. As used herein, the term "damage" refers to any impairment of the capability of a casing or other tubular to form a reliable and impermeable conduit for well fluids. Thus, the term refers not only to such a tubular that has been subjected to specific harm resulting in such impairment, but also to such impairment that might occur through degradation such as that caused by corrosion or other degradation; and also as may occur through intentional breaching such as through perforations that are no longer desirable, such as where a zone has ceased producing desired fluids.

Recently, hangers have been proposed that are unitary devices that may be deformed such that the device will engage a casing sidewall. While such proposed devices offer the advantage of being less expensive than alternatives of the types noted above, they also suffer from the deficiency of having a relatively limited amount of deformation that is possible. These devices, therefore, may not be suitable for use where the casing dimensions are not known, or are not within an anticipated relatively limited range of tolerances for the anticipated casing type. Where the operable range of deformation is not adequate to fully span the gap between an acceptable nominal tool outer diameter and, for example, a somewhat oversized casing inner diameter from what is expected, such hangers may fail to adequately support the attached structures in the desired placement within the wellbore. This can lead to failure to achieve the intended purpose, and in some cases to costly retrieval or "fishing" operations to remove the structures from the wellbore.

Accordingly, the present invention provides new methods and apparatus for supporting structures within a casing or other tubular within a wellbore. In many embodiments, these apparatus can be of relatively simple construction, leading to relative ease and lower cost of manufacture; while at the same time offering an improved range of effective operation. Although such methods and apparatus are useful for a number of purposes, particular benefits are found in operations where the attached structures are intended to remain within the wellbore.

SUMMARY

The present invention provides a new and enhanced hangar construction that may be used to tool strings within a wellbore. As used herein, a "tool string" is any one or more tools or pieces of equipment that are desired to be placed in a wellbore. These new hangars include at least one deformable section, which will allow the hangar to be placed in a wellbore with the deformable section in a first, relatively retracted position; and to then be actuated to extend the deformable section extend radially outwardly relative to the remainder of the tool string, to a second, radially extended position, where further expansion is restricted by compressive engagement with the surrounding sidewalls. In preferred embodiments, these hangars also include a contact element carried by the deformable section, and which will be urged radially outwardly during the setting process. Where the dimensions of the surrounding casing or other tubular pen-nit, the deformable section will extend radially for a first dimension relative to the remainder of the tool string, and the contact element will also extend radially relative to the deformable section.

Also contemplated by the present invention are improved tool strings made possible by hangers as described herein. An example of one such tool string of an improved construction facilitated through use of the described hanger is a casing repair tool string, as described in more detail later herein.

BRIEF DESCRIPTION OF THE DRAWINGS

Referring now to the drawings in more detail, therein are depicted various embodiments demonstrating examples of apparatus in accordance with the present invention. In the drawings, where different embodiments have components that are essentially the same as previously-discussed components, and function in a similar manner, those components have typically been identified with identical numerals, for ease of understanding.

FIG. 3A depicts a hanger assembly similar to that of FIG. 2, depicted in vertical section within a cased borehole; while FIG. 3B depicts an identified portion of the hanger of FIG. 3A in greater detail.

FIG. 4A depicts the hanger of FIG. 3A during the course of a setting operation, again in vertical section; and FIG. 4B depicts the identified portion of FIG. 4A in greater detail.

FIG. 5 depicts the hanger of FIGS. 3 and 4 after conclusion of the setting operation.

FIG. 6 depicts a representative section of another example of a hangar structure in accordance with the present invention.

FIG. 7 depicts an alternative structure for a deformable section of a hanger, such as that depicted in FIG. 6.

FIG. 8 depicts an example of the hanger portions of a casing repair tool string utilizing multiple hangers, in accordance with the present invention, depicted in vertical section.

FIG. 9 depicts a casing repair tool string having multiple hangers, as discussed in reference to FIG. 8.

FIGS. 10A-B depicts an example of an alternative setting sleeve assembly suitable for use with the present invention, depicted in vertical section; depicted in FIG. 9A in an unactuated state, and in FIG. 9B in a released state.

FIGS. 11A-C depict one example of an alternative extensible ring for use with the present invention, where the ring has a non-uniform cross section.

DETAILED DESCRIPTION OF PREFERRED EMBODIMENTS

The following detailed description refers to the accompanying drawings that depict various details of embodiments selected to show, by example, how the present invention may be practiced. The discussion herein addresses various examples of the inventive subject matter at least partially in reference to these drawings and describes the depicted embodiments in sufficient detail to enable those skilled in the art to practice the invention. However, many other embodiments may be utilized for practicing the inventive subject matter, and many structural and operational changes in addition to those alternatives specifically discussed herein may be made without departing from the scope of the invented subject matter.

In this description, references to "one embodiment" or "an embodiment" mean that the feature being referred to is, or may be, included in at least one embodiment of the invention. Separate references to "an embodiment" or "one embodiment" in this description are not intended to refer necessarily to the same embodiment; however, neither are such embodiments mutually exclusive, unless so stated or as will be readily apparent to those of ordinary skill in the art having the benefit of this disclosure. Thus, the present invention can include a variety of combinations and/or integrations of the embodiments described herein, as well as further embodiments as defined within the scope of all claims based on this disclosure, as well as all legal equivalents of such claims.

Figure 1:
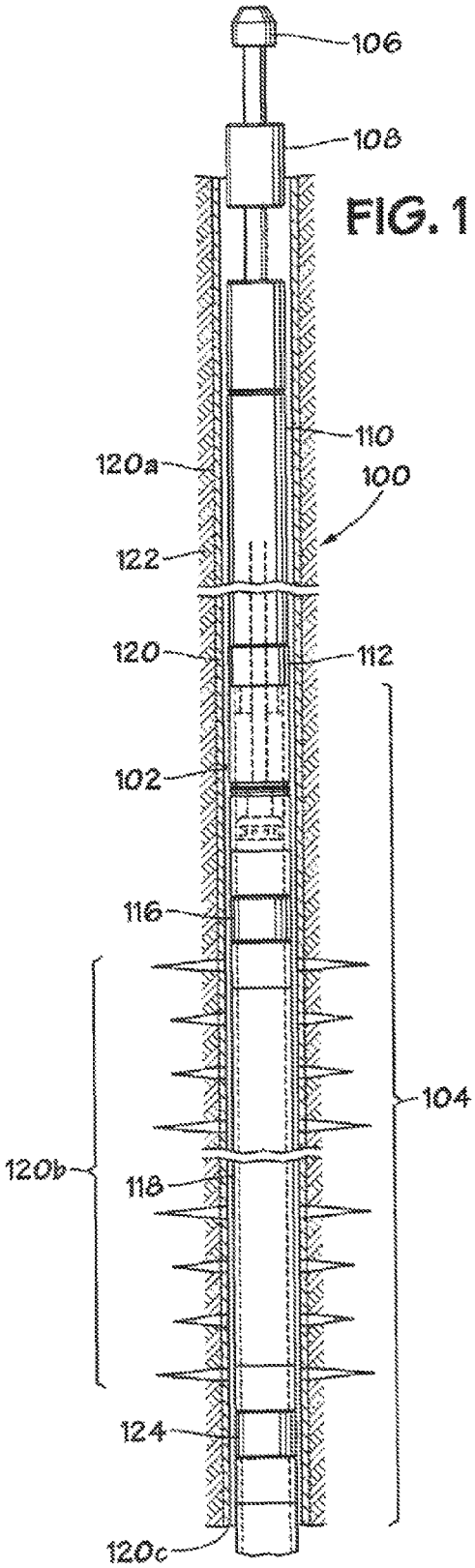
FIG. 1 depicts an example of a casing repair tool string as may benefit from use of the present invention, depicted in an example of an intended operating environment within a cased borehole.

Referring now to the drawings in more detail, and particularly to FIG. 1, therein is depicted one example of a casing repair tool string, indicated generally at 100, incorporating a hanger assembly 102 of an enhanced design, as described in more detail later herein. As will be apparent to those skilled in the art, tool string 100 is provided merely as representative of one possible use for the enhanced hanger design, which is as a component of an improved casing repair assembly, indicated generally at 104. Tool string 100 is configured to be placed within a wellbore through use of slickline. Accordingly, tool string 100 includes a slickline attachment head 106, as is well-known in the industry. Coupled below slickline attachment head 106 is a tool jar assembly 108, again as is well-known in the industry. Tool string 100 may also include one or more weighted sections, commonly referred to as "weight bars" (not illustrated) that may be used to provide additional weight to assist the downward movement of the tool string through the wellbore.

Tool string 100 then includes a setting tool 110 that will be used to set at least hanger assembly 102. Setting tool 110 may be of any suitable type known in the industry to cause a movement that may be used to set a device such as hanger assembly 102. Such tools that are known in the industry include explosively-actuated setting tools, hydraulically-actuated setting tools, and electrically-operated setting tools. Although explosively-actuated setting tools may be used, the use of a more gradual and controlled actuation resulting from a controlled-force setting tool is preferred. With such a controlled-force setting tool, the setting movement within the tool will be gradual, extending at least over several seconds, and preferably up to a minute or even longer. Accordingly, hydraulically-actuated and electrically-actuated setting tools are preferred for their ability to provide this controlled-force setting movement. An example of one preferred type of setting tool is the Downhole Power Unit, as provided by Halliburton Energy Services. For purposes of the present example, setting tool 110 will be discussed as being such a downhole power unit. A description of an exemplary downhole power unit may be found in issued U.S. Pat. No. 7,051,810, assigned to the owner of the present application, and including the current inventor as one of the named inventors. U.S. Pat. No. 7,051,810, is incorporated herein by reference for all purposes.

In brief, such a downhole power unit includes a battery pack formed of one or more discrete batteries which provide electrical current to a motor used to operate a screw and traveler. Operation of the motor is conventionally set by use of a timer, which is set to allow time for the equipment to be run to a desired location in the well; after which time expires, the timer will actuate a switch causing operation of the motor. The motor will rotate the screw, thereby establishing a linear movement which will be conveyed through a mechanism such as an actuation rod to provide the setting actuation to another device, here hanger assembly 102. As will be apparent to those skilled in the art, there are alternatives to use of such a timer to initiate actuation of the motor, or another type of setting tool. Various systems have been proposed for communicating with slickline operated tools, including systems which decode any of: patterns of motion of the tool string, tension applied to the slickline, and pressure pulses generated within the well. Additionally, cables having one or more optical fibers are also sometimes, referred to as "slickline." Also, most forms of wireline have either single, dual or further multiple conductors, and sometimes may also include optical fibers. Where such electrical or optical conductors are present, communication over the electrical conductor(s) or optical fiber(s) may be used to send a signal to an attached tool string. Thus, tool string 100 may be conveyed not only by slickline, but by conventional wireline or on a tubular member, such as coiled tubing. Accordingly, any appropriate method for communicating with the tool string may be used, including but not limited to the above-identified communication methods, depending on whatever means is used to convey the tool string into the wellbore.

The downhole power unit setting tool 110 engages, through an adapter sub 112, casing repair assembly 104. Casing repair assembly 104 is provided as one example of a system that can particularly benefit from the use of the described enhanced hanger assembly 102. Many other types of systems can also be utilized with enhanced hanger assembly 102, such as, by way of example only, other types of repair assemblies, such as might be utilized to repair other tubulars within a wellbore or to otherwise isolate other sections within a borehole. The example casing repair assembly 104 includes hanger assembly 102, which is coupled either directly, or through a length of tubular 114, to a first packer assembly 116. First packer assembly 116 can be of any of many known packer configurations. However, one particularly preferred packet type for use in a casing repair system such as that illustrated is a packer having a swellable elastomeric packer element. Such packers include an elastomeric element that expands when exposed to certain types of fluid. First packer assembly 116 will be selected of a type designed to in the fluids which will be found within the wellbore in which the packer is to be placed. For example, in a wellbore for the production of oil, an elastomeric element which expands when contacted by the appropriate fluids will be selected for use. Examples of such packers are those known by the trade mark Swellpacker, as provided by Halliburton Energy Services. Additionally, an exemplary packer of this type is described in U.S. Pat. No. 7,051,810, also assigned to the owner of the present application, and which patent is incorporated herein by reference for all purposes. First packer assembly 116, as well as second packer assembly 124, address below are each depicted with a packer element of a relatively short longitudinal dimension. Those skilled in the art will recognize that such packers with swellable packer elements may often include elements that are several feet long.

A repair conduit 118 is coupled, at its upper end, either directly or indirectly, to packer assembly 116. Repair conduit 118 will typically be selected to be of the maximum outer diameter meeting operational constraints for placement within the casing 120 within the borehole 122, within which tool string 100 is depicted. As is known to those skilled in the art, the length of repair conduit 118 will be selected to be sufficient to span the length of casing for which repair is intended. Thus, repair conduit 118 may be a few feet long or could in some cases be over a hundred feet long, or possibly over several hundred feet long.

A second packer assembly 124 will be coupled, either directly or indirectly, to the lower end of repair conduit 118. Again, second packer assembly 124 may be of any desired type; but preferably will again be a swellable packer assembly similar to, or the same as, that selected for packer assembly 116. Thus, casing repair assembly 104 provides a straddle packer configuration to isolate an annulus between repair conduit 118 and the adjacent section of casing 120b, from the interior of casing section 120*a*, above packer assembly 116, and also from the interior of casing section 120*c*, below packer assembly 124; thereby isolating the remainder of the wellbore from the wellbore adjacent the damaged section of casing 120*b*.

Figure 2:
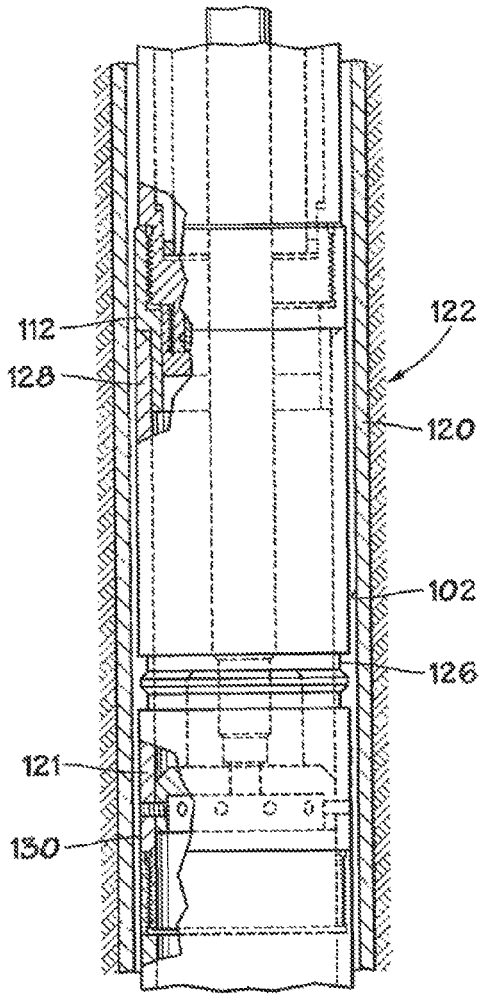
FIG. 2 depicts an example of a hanger assembly, with internal structures depicted in dashed lines.

Referring now to FIG. 2, therein is depicted adapter sub 112 and hanger assembly 102 in greater detail, with the internal components depicted in dashed line. Reference is also made to FIG. 3A, which depicts adapter sub 112 and hanger assembly 102 in vertical section; and to FIG. 3B, that depicts deformable section 126 of hanger assembly 102 in greater detail. Hanger assembly 102 includes a body member 121 which is preferably constructed as a unitary member, although an assembly of multiple components is possible. Body member 121 will preferably be formed of annealed steel such as 10-18 or 10-20 steel. Hanger assembly 102 includes a deformable section, indicated generally at 126, between an upper body section 128 and a lower body section 130. Deformable section 126 is constructed with a configuration that will deform in response to axial compression of hanger assembly 102, such deformation resulting in radial expansion of a central engagement portion, indicated generally at 132 in FIG. 3B. One preferred construction to enable this deformation includes an internal recess 134, representing a relatively short longitudinal section having a relatively expanded internal diameter with two accompanying external recesses 136 and 138 longitudinally above and below central engagement section 132. In one example configuration, upper and lower body sections 128, 130 will each have a nominal wall thickness of 0.465 inch, and each of recesses 136 and 138 will have a bottom surface that extends longitudinally for approximately 0.250 inch on either side of engagement portion 132, and will have a depth from the outer surface of also approximately 0.250 inch. Preferably, internal recess 134 is defined by opposingly-sloped sidewalls 140 and 142.

Additionally, an outermost surface of engagement portion 132 preferably defines an external recess 144. As best depicted in FIG. 3B, external recess 144 is defined by opposingly-sloped sidewalls 146 and 148 that will be compressed toward one another during the course of the above-described deformation, thereby reducing the dimension of external recess 144. In one example implementation of forming both engagement portion 132 and internal recess 134, the described deformation is facilitated by having a sidewall portion proximate engagement portion 132 which is generally uniform, thereby defining two sideways-V-shaped contours in internal recess 134, and an opposing sideways-V-shaped contour in engagement portion 132, extending between the two sideways-V-shaped contours in internal recess 134. As will be apparent to those skilled in the art, many alternative configurations for deformable section 126 may be envisioned. For example, deformable section 126 might include two or more engagement portions. Additionally, many other configurations might be defined for deformable section 126 which are also sufficient to result in radial expansion of an engagement portion of the deformable section, and that are sufficient to result in the described further deformation of external recess 144.

As noted previously, while unitary, expandable anglers have been proposed in the industry, such devices are believed to suffer from the limitation of having a relatively limited range of deformation relative to variances in the size of casing or other tubulars which are commonly found in actual operations. Accordingly, described herein is a hanger assembly 102 that includes a second extensible mechanism associated with engagement portion 132. In the depicted example of this second extensible mechanism, extensible member 150 is retained within external recess 144. In one example, this extensible member 150 is a metallic member, such as ring, and may be formed either of a metal or metal alloy. In one example, extensible member 150 will be formed of the same steel as that of which body member 121 is formed. While described as non-metallic, in some example embodiments, the extensible member 150 may also non-metallic (e.g., ceramic, elastomer, etc.). As depicted in FIG. 3B, the ring has innermost surfaces defining a general V-shaped interior profile designed to engage a complementary profile defining external recess 144. In one preferred construction, these surfaces, indicated generally at 146, will define respective angles of approximately 90 degrees. The ring also has a limited radial dimension, such that when engagement portion 132 of hanger assembly 102 is in an un-actuated state (as depicted in FIG. 3A), the ring has an external diameter no greater than the nominal external diameters of upper and lower body sections 128 and 130 of hanger assembly 102. The ring will also include a cut or separation so that it is radially expandable in response to the described deformation of deformation section 126. As will be addressed in more detail later herein, other configurations for extensible member 150 maybe used.

As best shown in FIG. 3A, hanger assembly 102 includes an internal setting sleeve indicated generally at 154. Many configurations for internal setting sleeve 154 are possible to provide a releasable connection to lower body section 130 of hanger assembly 102. Setting tool 110 is depicted threadably engaged at 156 to adapter sub 112. Adapter sub 112 then rests against an upper shoulder 158 of upper housing body 128. Setting tool 110 includes an actuation rod 160 that extends through a sealing assembly, indicated generally at 162, in setting tool 110, and through a seal section 164 in adapter sub 112; and is secured to internal setting sleeve 154 of hanger assembly 102. In one example, actuation rod 160 will be threadably coupled, at 166, to internal setting sleeve 154; and will be retained in such coupling through use of one or more set screws 168. Internal setting sleeve 154 is coupled to lower body section 130 by a plurality of circumferentially disposed shear pins 170. Thus, when tool string 100 is disposed in a wellbore as depicted in FIG. 1, the entire connection between adapter sub 112 and all components above it, to hanger assembly 102 and all components below it, is through shear pins 170 coupling internal setting sleeve 154 to lower body section 130. The number and shear threshold of shear pins 170 may be selected in accordance with well-known principles. In most configurations, a tool string such as that depicted in FIG. 1 might be expected to have a weight of approximately 500-600 pounds. However, because the shear pins most support all the weight of the assembly below, as well as withstand the force applied to cause the described deformation, it will be preferable to have substantial additional design tolerance before anticipated shearing of the pins. In some example embodiments, in systems which have been implemented, the use of shear pins each having a design shear threshold of approximately 5,000 psi, in numbers adequate to provide a total shear threshold of between 20,000 and 30,000 psi, has been found adequate. Shear pins having a design shear threshold of other levels of psi (either higher or lower) may also be used.

The operation of the described tool string 100 will now be addressed in reference to all of the above-discussed Figures. For purposes of this example, it will be assumed that the operation is to be performed in 4.5 inch, 13.5 pound casing. In some other example embodiments, different size or weight of casing may be used. Also, as is well known to those skilled in the art, casings of the same external diameter will have different internal diameters and different tolerance ranges of permitted diameters depending upon the weight of the casing, which directly affects the wall thickness. For the described casing, such casing should have a nominal internal diameter of 3.92 inches, with a minimum ID of 3.85 inches, and a maximum ID of 3.99 inches. In an operation to be performed in such casing, the preferred method would be to form a tool string 100 wherein at least the permanent components, those components that will remain in the well after the operation, all have a maximum outer diameter no greater that 3.84 inches, and preferably have the maximum feasible ID. In this example of tool string 100, the components that will remain permanently in the well are hanger body 121 of hanger assembly 102, and all components coupled below it, including upper packer assembly 116, repair conduit 118 and second packer assembly 124. As will be apparent to persons skilled in the art, the tool dimensions will change for various configurations of casing or other tubulars. The selection of tools having an appropriate diameter for such casing types is well-known.

As is well known in the industry, although in the performance of an operation such as that to be described, one will typically have access to the well plan, which will indicate the casing type and other components placed within the wellbore, such well plans may or may not be entirely accurate. Additionally, in some cases, such as in wells in which the casing has been in place for many years, degradation may have occurred to the casing such that the dimensions that may have been accurate for the casing when it was installed are no longer accurate, such as due to corrosion or other damage resulting in an effective expansion of the solid surface internal diameter of the casing. Additionally, undocumented or unexpected obstructions may also exist within a wellbore. Accordingly, it is always preferred to run at least a gauge ring in the wellbore before the introduction of tool string 100 to assure at least that there will be sufficient passage for the tool string to be lowered to its intended placement. In general, a clearance of 0.030 inch between a tool string OD and a casing ID is considered adequate to allow traversal of the tool string through the casing, though exceptionally long tool strings could dictate using a greater clearance.

The enhanced design of casing hanger described here allow improved expansion, and therefore is more adaptable that other proposed systems to unexpectedly large clearance between the unactuated hanger body and the casing. Nevertheless, in cases such as where there is reason to expect the possibility of corrosion or other damage to the casing, or where there is any uncertainty as to what weight casing may have been used, either resulting in some uncertainty about what the actual ID of the casing is where tool string 100 is to be placed, it will still often be preferred to run a casing caliper at least through that portion of the wellbore. A casing caliper will provide useful information regarding the diameters that may be expected. However, most such calipers will not provide resolution sufficient to assure the precise dimension at the specific location at which the hanger will engage the casing sidewall. Accordingly, even with such information, the additional expansion capability obtained through use of the described hanger is of substantial benefit.

Once the appropriate dimensions, and thus the components for use in tool string 100, have been identified for the well in question, tool string 100 will be assembled and run into the well, either on slickline or through any other appropriate mechanism, as mentioned earlier herein. Once tool string 100 has been a lowered to the appropriate depth to place packer assemblies 116 and 124 on longitudinally-opposing sides of damaged casing section **120*b*, with repair conduit 118 spanning such damaged casing section, then setting of hanger assembly 102 will be initiated. In the case of a timer-controlled setting tool 110, tool string 100 will be supported at the appropriate depth until be defined time has elapsed, at which point operation of setting tool 110 will initiate. In some example embodiments, the operation of setting tool 110** may also be initiated by a control signal from the surface that is communicated via the conductor cable. As is apparent from the prior discussion, other types of events may be utilized to initiate operation of a setting tool as appropriate depending upon the setting tool and conveying mechanism utilized.

Upon actuation of downhole power unit setting tool 110 as described herein, the motor within setting tool 110 will start upward movement of actuation rod 160 relative to upper body section 128 of hanger assembly 102. Because adapter sub 112 is shouldered on upper body section 128, and internal setting sleeve 154 is coupled to lower body section 130, this movement causes axial compression between the ends of body member 121, causing the described deformation. Referring now also to FIGS. 4A-B, therein is depicted hanger assembly 102 as this deformation has begun to occur. The deformation has caused the radial extension of engagement portion 132, and has further caused deformation reducing the dimension of external recess 144 causing radial extension of extensible member 150. Thus, the addition of extensible member 150 allows greater radial extension than would be possible just through expansion of engagement portion 132 alone.

In a configuration such as that depicted and described, with a hanger nominal OD of 3.84 inches in the un-actuated state, an axial compression of hanger assembly 102 of approximately 0.250 to 0.375 inch has been found adequate to cause the described and depicted deformation within the described casing. Depending upon the exact dimensions of the expandable portion 132 and extensible member 150 the precise amount of deformation may vary. In a system having the dimensions of the deformable section as described earlier herein, the expandable portion 132 should have the capability of expanding at least 0.20 to 0.30 inch beyond the nominal OD of hanger body number 121; and extensible member 150 should have the capability to deform outwardly between 0.100 and approximately 0.200 beyond of the outermost surface of extendable portion 132. As will be apparent however, in operating environment, the maximum radial extension will not be obtained, as expansion of at least one of expandable portion 132 and extensible member 150 will be constrained by the surrounding casing sidewall which is engaged.

The use of a setting tool having a motor speed and thread pitch sufficient to provide an axial movement of actuation rod 160 of approximately 0.5 inch per minute has been found to provide suitable deformation. Thus, upon actuation of such a setting tool, setting of the hanger requires approximately 30 and 60 seconds to complete, including some time expended to remove any gaps and/or other slack between the operative components within the system. Although it will be apparent to those skilled in the art that differences in the precise dimensions and configuration for any deformable section that may be designed for use may result in different degrees of potential deformation and therefore radial extension, it is believed that the provision of the deformable external recess 144 and extensible member 150 adds further radial extension to any such configurations.

Referring now to FIG. 5, therein is depicted hanger assembly 102 after it has been fully set within casing 120, and shear pins 170 have sheared, releasing internal setting sleeve 154, and allowing it, along with adapter 112, setting tool 110 and all other components above it, to be removed from the wellbore. In the case of a casing repair operation tool string as described in this example, the hanger 102 will provide mechanical support of the repair assembly at least until the swellable packers deform to not only seal off the wellbore but also provide some additional mechanical support of the repair assembly. The time required for expansion of the swellable packer elements will vary depending upon the specific packers utilized. However full expansion and sealing can often require a least a day, and potentially several days.

One particular advantage for a repair assembly such as the described example of casing repair assembly 104 is that the swellable packers provide a maximum internal diameter, thereby providing minimal restriction in the wellbore as a result of the casing patch. As is well known, packers which include mechanical slip assemblies require additional dimension for the slips and their actuation mechanisms, thereby resulting in a relatively smaller internal diameter. The described hanger assembly 102 also provides a maximum internal diameter through repair assembly 104; and the mechanical engagement provided by hanger assembly 102 facilitates the use of packers without slips. Thus, the described components have complementary capabilities to enable a casing repair assembly offering advantages not previously known to the industry.

Referring now to FIG. 6, there is depicted an alternative embodiment of a hanger assembly 180. Hanger assembly 180 includes three deformable sections 182, 184 and 186. Any number of desired deformable sections maybe included. For example, for hangers to be deployed in larger casing sizes, because of the possible greater weight of such tool strings, it may be preferable to provide hangers having multiple deformable sections. In this example, the two lowermost deformable sections 184 and 186 are constructed in the same manner as described in reference to FIGS. 3A-B. However, upper-most deformable section 182 includes annular elastomeric elements 188, 190 in recesses 192, 194 on opposite sides of engagement portion 196. Additionally, in this example, extensible member 200 within deformable section 182 is also an elastomeric element. As was discussed previously, the provision of a metallic extensible member (150 in FIG. 3A), requires that such member be split, in order to allow the described radial expansion. As a result, even if all external surfaces of that extensible member fully engage the inner sidewall of the casing, a fluid flow path still exists around the hanger due to the split. The inclusion of a deformable section including one or more elastomeric members provides a mechanism to form an annular seal completely around hanger assembly 180. One advantage of using an elastomeric element in an expandable section results from the holes 198 in the body member provided to accommodate the shear pins to couple the body member to the setting sleeve. After removal of the setting sleeve, these holes can allow fluid communication between a upper well annulus 120*a* and the interior of the hanger body member and thus the interior of the repaired casing. The expandable section with an elastomeric seal can seal off that communication. Many variations for forming an continuous seal might be utilized, including one in which the only elastomeric element would be one such as an elastomeric O-ring 200 used as the extensible member in a deformable section, as depicted in FIG. 7. Additionally, an embodiment might be used wherein the elastomeric elements 188 and 190 were used, but either without an extensible member within engagement portion 196, or again using a metallic extensible member as previously described.

Referring now to FIGS. 8 and 9, therein is depicted an alternative embodiment of a tool string 210 having tubular member repair assembly 220 which utilizes two hanger assemblies 222, 224. In this example, an uppermost hanger assembly 222 is placed in repair assembly 220 in a placement similar to that described in reference to FIGS. 1-4. However, the additional hanger assembly 224 is located proximate the bottom end of repair assembly 220. In this embodiment, provision needs to be made for extension of the actuation rod from the setting tool 110 to engage not only the uppermost internal setting sleeve 226 of hanger assembly 222; but also lower internal setting sleeve 228 of hanger assembly 224. As will be apparent to those skilled in the art having the benefit of this disclosure, many structures can be used to achieve this extension of actuation rod and coupling to both internal setting sleeves 226, 228. As one example of such a system, the actuation rod 160 may be formed in multiple sections, 160*a*, 160*b*. For example, section 160*a* might extend to engage uppermost internal setting sleeve 226, and extend further through and below the sleeve. There, a threaded coupling 230, preferably including at least two set screws 232*a*, 232*b* for security, can couple the two sections 160*a*, 160*b*. Threaded coupling 230 can be formed as a separate sleeve that would threadably engage both sections 160*a*, 160*b* to couple them together. It is also possible, although more expensive, to configure one section as having been a male threaded end, with the other section having a complementary female threaded end, such that the two sections 160*a*, 160*b* may be correctly threaded together.

Additionally, FIG. 8 depicts an alternative configuration for internal setting sleeve 228 that may be used whether there are multiple internal setting sleeves or only a single one. Internal setting sleeve 228 defines a threaded bore 234 that extends through the sleeve. Additionally, actuation rod section 160*b* is depicted with a relatively extended threaded section 236. With this structure, actuation rod section 160*b* may be threadably adjusted to the appropriate placement relative to setting sleeve 228, and then secured in position with one or more set screws 238. With this structure, adjustments of the relative placement between actuation rod section 160*b* and setting sleeve 228 may be made more easily, than where such relative adjustment is not available.

Referring now to FIG. 9A-B, therein is depicted an example of an alternative configuration for a hanger assembly 240 in accordance with the present invention. Generally, in place of a shear-pinned internal setting sleeve, hanger assembly 240 is configured with a collet retention between setting sleeve assembly 242 and hanger body 244. One advantage of using a collet system is that it avoids the holes in the body member where the shear pins are located, as discussed in reference to FIG. 6.

Setting sleeve assembly 242 includes a body section 246, again configured to threadably engage an actuation rod 160, as described previously herein. A backup sleeve 250 extends around body section 246; and an annular collet sleeve 252, extends around backup sleeve 250. Backup sleeve 250 includes an upper shoulder 254 that extends radially outwardly to engage an upper portion of collet sleeve 252, and a lower collet support section 256 that also extends radially outwardly. Backup sleeve 250 is pinned by a plurality of shear pins 258 in fixed, but releasable, relation to body section 246. Collet sleeve 252 includes an upper contiguous portion, indicated generally at 260, with a plurality of individually movable collet fingers, indicated generally at 262, extending downwardly from contiguous portion 260. An inwardly-extending lip 264 extending from contiguous portion 260 of collet sleeve 252 prevents downward movement of collet sleeve 252 relative to backup sleeve 250. Additionally, collet fingers 262 rest against a lower support shoulder 268 formed in lower collet support section 256 of backup sleeve 250. Preferably, collet sleeve 252 will be manufactured such that collet fingers 262 tend toward a radially retracted position.

Body section 246 includes an upper support shoulder 266 extending radially outwardly relative to the remainder of body section 246. A coiled spring 270 extends around body section 246, and is longitudinally retained between upper support shoulder 266 and backup sleeve 250. A threaded end cap 272 facilitates assembly of the above components, and also provides a catch shoulder 274.

Hanger assembly 240 is assembled with collet heads 276 of each collet finger 262 retained within an annular recess 278 in the internal diameter of hanger body 244, and the collet fingers are secured in that position by the engagement of lower support section 254 of backup sleeve 250, with each collet finger 262, not only at a back surface 280 but also on a lower surface 282. As a result of such assembly, setting sleeve assembly 242 is secured in generally fixed relationship to a lower portion of hanger body 244, through engagement of collet fingers 262 with annular recess 278, and through the shear pinning of backup sleeve 250 to body 246, with only a limited range of downward movement of backup sleeve 250 (and attached body section 246), relative to collet sleeve 236. This limited downward movement of actuation rod 260 and body section 246 will be possible against the compression of coiled spring 286, but upward movement will not be possible due to the engagement of lower collet support section 254 with lower surface 282 of each collet finger 262.

Accordingly, when the setting tool is actuated to draw actuation rod 160 upwardly, the force will be applied, through sheer pins 258 to backup sleeve 250, and through lower surface 282 to each collet finger 262, and thereby to hanger body 244. Thus, again, setting sleeve assembly 242 induces axial compression in hangar body 244 sufficient to cause deformation of deformable section 284, as depicted in FIG. 9B, thus setting the hangar assembly within the depicted casing 286. As with the previously described embodiment, as force continues to be applied, shear pins 258 will shear, thereby releasing backup sleeve 250 from its fixed engagement relative to body section 246. At such time, coiled spring 270 will exert a downward force on backup sleeve 250, driving lower support section 254 out of engagement with collet fingers 262, thereby allowing them to move inwardly (as depicted in FIG. 9B), thereby releasing setting sleeve assembly 242 from hanger body 244, and allowing the setting sleeve assembly 242 to be withdrawn from the wellbore.

Referring now to FIGS. 11A-C, therein is depicted an alternative construction for a split ring 190 suitable for use as extensible member. As previously noted, one configuration for the extensible member is to have a uniform, generally triangular, cross-section; and to be formed of steel of the same or a similar type to that used in a hanger body. However, even where the extensible member is a metallic split ring as described earlier herein, more complex shapes or material treatments may be used. Ring 190 includes a plurality of chamfers 192 extending across the outermost face 194 of ring 190. These chamfers 192 thereby define a number of edges, as at 196 and 198, to provide separate gripping surfaces that may be useful in obtaining secure engagement with some surfaces. Additionally, various treatments may be applied to ring 190 to further improve its engagement capability. For example, ring 190 may have hard facing applied to it, either to the entire ring, or to selected sections, such as on chamfers 192. Such hard facing would preferably be by an applied coating. However the construction of ring 190 with multiple materials, such as tungsten or similar segments, retained within a steel body or matrix might also be used.

Many modifications and variations may be made to the structures and methods described herein without departing from the spirit and scope of the present invention. For example, as noted previously, the deformable sections may be constructed with a wide variety of specific conformations. Additionally, many types of collet assemblies might be used with a setting sleeve to facilitate the described engagement and release of collet fingers. Additionally, many configurations for extensible elements, whether they are metallic, elastomeric, or of some other construction may be envisioned. Also, other tool strings may be used with a hanger assembly constructed in accordance with the teachings herein; and additional components may be included within those tool strings. As but one example, an additional swellable packer might be included in a casing repair tool string to provide a seal between an upper annulus and any holes in the body member, as previously described. Accordingly, the scope of the present invention is limited only by the claims and the equivalents of those claims.

I claim:

1. A hanger, comprising:

a first body section defining a first portion of a central passage, said first body section having a first internal surface defining a first internal diameter of the central passage and an external surface defining a first outer diameter;

a second body section defining a second portion of the central passage, said body section having a second internal surface defining a second internal diameter and a second external surface defining a second outer diameter;

a deformable section disposed intermediate said first and second body sections, said deformable section configured to deform from a first position to a second position in response to relative axial compression between said first and second body sections, said deformable section having an outer contact surface configured to extend outwardly when said deformable section deforms to said second position, and having an inner surface defining a third portion of the central passageway; and at least one contact member supported proximate said outer contact surface.

2. The hanger of claim 1, further comprising a setting mechanism retained at least partially within said central passage and configured to establish a releasable connection with said second body section.

3. The hanger of claim 1, wherein said contact member comprises a radially-expandable metallic component.

4. The hanger of claim 3, wherein said metallic component comprises a plurality of gripping surfaces formed in an external surface.

5. The hanger of claim 3, wherein the contact member comprises a metallic outermost surface, and wherein the metallic outermost surface comprises one or more edges configured to mechanically engage and adjacent surface.

6. The hanger of claim 1, wherein said deformable section comprises surfaces defining at least one recess in said external surface, and surfaces defining at least one recess in said internal surface.

7. The hanger of claim 1, wherein said outer contact surface comprises a recess, and wherein said contact member is disposed within said recess.

8. The hanger of claim 7, wherein said recess in said outer contact surface is an annular recess.

9. The hanger of claim 8, wherein said recess is defined by surfaces configured to lessen the dimension of said recess when said deformable section moves from said first position to said second position.

10. The hanger of claim 9, wherein said surfaces define an angled recess when said deformable section is in said first position, and wherein said contact member is a metallic member having surfaces configured to engage said surfaces defining said angled recess 11. The hanger of claim 1, wherein at least the first body section, the second body section and the deformable section are all portions of a unitary structure.

12. A method for securing a tool string within tubular member within a wellbore, comprising the acts of:

placing said tool string within said tubular member, said tool string comprising a hanger having a deformable section intermediate two ends, said deformable section having an engagement section with surfaces defining a recess, said recess configured to also be deformable, said hanger further including a radially expandable, metallic contact member supported within said recess, the contact member having an inner surface contacting at least one surface defining the recess;

applying axial compression between the two ends of said hanger sufficient to cause deformation of said deformable section sufficient to move the engagement section radially outwardly, toward said tubular member and to further cause deformation of said recess sufficient to expand the diameter of the inner surface of said metallic contact member to urge said contact member radially outwardly toward said tubular member.

13. The method of securing a tool string of claim 12, wherein said hanger comprises a plurality of deformable sections.

14. A method for securing a tool string within tubular member within a wellbore, comprising the acts of:

placing said tool string within said tubular member, said tool string comprising, a hanger having a deformable section intermediate two ends, said deformable section having an engagement section with surfaces defining a recess, said recess configured to also be deformable, said hanger further including a contact member supported within said recess;

at least one packer; and applying axial compression between the two ends of said hanger sufficient to cause deformation of said deformable section sufficient to move the engagement section radially outwardly, toward said tubular member and to further cause deformation of said recess sufficient to urge said contact member radially outwardly toward said tubular member.

15. The method of securing a tool string of claim 14, wherein said at least one packer comprises a packer having a swellable packer element.

16. The method of securing a tool string of claim 14, wherein said tool string further comprises at least a second packer.

17. A hanger assembly, comprising:

a body member having an external surface and two ends, and defining a central passage, said body member comprising, a first deformable section configured to deform radially outwardly from a first position to a radially expanded position in response to axial compression between said ends of said body member, said first deformable section having a first outer engagement surface configured to extend radially when said deformable section deforms to said radially expanded position, and a second deformable section configured to deform radially outwardly from a first position to a radially expanded position in response to said axial compression between said ends of said body member, said second deformable section having a second outer engagement surface configured to extend radially when said deformable section deforms to said radially expanded position;

at least one contact member supported proximate said first outer contact surface; and at least one contact member supported proximate said second outer contact surface.

18. The hanger assembly of claim 17, wherein at least one of said contact members is a metallic member.

19. The hanger assembly of claim 17, wherein at least one of said contact members is an elastomeric member.

20. The hanger assembly of claim 17, wherein at least one of said deformable sections comprises an external recess in said body member proximate said engagement surface, and further comprising an elastomeric member in said external recess.

21. The hanger assembly of claim 17, wherein each of said first and second engagement surfaces comprises a respective external recess, and wherein one of said contact members is retained in said recess.

22. A repair assembly for repair of a wellbore tubular member, comprising:

a hanger assembly comprising, a body member including a deformable section intermediate two ends, said deformable section configured to deform from a first unactuated position to second, radially expanded, position, said deformable section a having an engagement section that will be define the radially outermost surfaces of said body section when said deformable section is in said second position, said engagement section including surfaces defining a recess configured to also deform when said deformable section deforms to said second position, and a contact member supported within said recess;

a first packer assembly, said first packer configured to be settable without mechanical movement;

a tubular bridging assembly defining a tubular member having first and second ends, and coupled proximate a first end to said first packer; and a second packer assembly, said second packer also configured to be settable without mechanical movement, said second packer coupled proximate the second end of said tubular bridging assembly.

23. The repair assembly of claim 22, further comprising a setting mechanism configured to establish a releasable connection with said body member.

24. The repair assembly of claim 22, wherein said recess in said engagement section is defined by surfaces configured to lessen the dimension of said recess when said deformable section moves from said first position to said second position.

25. The repair assembly of claim 22, wherein said hanger assembly comprises a plurality of deformable sections.

26. The repair assembly of claim 25, wherein said hanger assembly further comprises at least one last elastomeric element proximate at least one of said deformable sections.

27. The repair assembly of claim 22, wherein at least one of said first and second packers comprises a swellable packing element.

28. A method for repairing a damaged section of a tubular member in a wellbore, comprising the acts of:

placing a repair assembly within said tubular member, said repair assembly comprising, a hanger assembly including a deformable section intermediate two ends, said deformable section having an engagement section with surfaces defining a recess, said recess configured to also be deformable, said hanger assembly further including a contact member supported within said recess;

a first packer configured to sealingly engage said tubular member without mechanical actuation, said first packer coupled in said repair assembly proximate said hanger assembly;

a tubular bridging assembly defining a tubular member having first and second ends, and coupled proximate a first end to said first packer; and a second packer configured to sealingly engage said tubular member without mechanical actuation, said second packer coupled proximate the second end of said tubular bridging assembly;

placing a setting assembly in operative engagement with said repair assembly;

actuating said setting assembly to axially compress said hanger assembly, and to thereby cause said deformable section to move from a first unactuated position to a second radially expanded position, and to further cause said recess to deform and to thereby urge said contact member radially outwardly relative to said engagement section.

29. The method of claim 28, further comprising the act of separating said setting assembly from said repair assembly.

30. The method of claim 28, wherein said hanger assembly further comprises a setting sleeve releasably coupled on a first longitudinal side of said deformable section.

31. The method of claim 30, wherein said setting assembly engages said setting sleeve when said setting assembly is in operative engagement with said repair assembly, and wherein said method further comprises the act of separating said setting assembly and said setting sleeve from said repair assembly.

32. The method of claim 30, wherein said repair assembly comprises a second hanger, and where said second hanger is placed on the opposite end of said tubular bridging assembly from said first hanger.

33. The method of claim 32, wherein at least one of said hanger assemblies comprises a plurality of deformable sections.

* * * * *

UNITED STATES PATENT AND TRADEMARK OFFICE

CERTIFICATE OF CORRECTION

PATENT NO. : 7,779,924 B2
APPLICATION NO. : 12/129229
DATED : August 24, 2010
INVENTOR(S) : Jack G. Clemens et al.

It is certified that error appears in the above-identified patent and that said Letters Patent is hereby corrected as shown below:

On the title page, in item (75), in "Inventor", in column 1, line 1, delete "Clamens," and insert -- Clemens, --, therefor.

On the title page, in item (75), in "Inventor", in column 1, line 1, after "(US)" insert -- ; James F. Benge, Longview, TX (US) --.

In column 13, line 31, in Claim 10, delete "recess" and insert -- recess. --, therefor.

Signed and Sealed this
Twenty-eighth Day of December, 2010

David J. Kappos

David J. Kappos
*Director of the United States Patent and Trademark Office*